US006478008B2

(12) United States Patent
Wolters

(10) Patent No.: US 6,478,008 B2
(45) Date of Patent: Nov. 12, 2002

(54) PISTON-TYPE INTERNAL COMBUSTION ENGINE HAVING A SUBDIVIDED GAS-INTAKE PORT

(75) Inventor: Peter Wolters, Eschweiler (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 09/899,056

(22) Filed: Jul. 6, 2001

(65) Prior Publication Data

US 2002/0020389 A1 Feb. 21, 2002

Related U.S. Application Data

(63) Continuation of application No. 09/738,975, filed on Dec. 18, 2000, now abandoned.

(30) Foreign Application Priority Data

Dec. 16, 1999 (DE) ..... 199 60 626

(51) Int. Cl.[7] ..... F02B 31/00

(52) U.S. Cl. ..... 123/306

(58) Field of Search ..... 123/306, 188.14

(56) References Cited

U.S. PATENT DOCUMENTS 3,861,376 A * 1/1975 Ashley ..... 123/188.14
5,295,464 A * 3/1994 Ando et al. ..... 123/188.14

* cited by examiner

*Primary Examiner*—Noah P. Kamen
(74) *Attorney, Agent, or Firm*—Venable; Norman N. Kunitz

(57) ABSTRACT

A piston-type internal-combustion engine having at least one gas intake port (4) per cylinder, with the port discharging into the cylinder via at least one throughgoing opening (3). The port is subdivided, over at least a portion of its length, into at least two partial ports (4.1, 4.2) by at least one partitioning wall (5). The wall has a profile with a central separating portion on at least one surface being raised relative to the remaining portions of the at least one surface, to divide a flow within an associated partial port (4.1, 4.2) into two partial flow parts, which extend in the flow direction.

8 Claims, 3 Drawing Sheets

PISTON-TYPE INTERNAL COMBUSTION ENGINE HAVING A SUBDIVIDED GAS-INTAKE PORT

CROSS REFERENCE TO RELATED APPLICATION

This application is a continuation of U.S. patent application Ser. No. 09/738,975, filed Dec. 18, 2000, abandoned.

This application claims the priority of German Patent Application No. 199 60 626.9 filed Dec. 16, 1999, which is incorporated herein by reference.

BACKGROUND OF THE INVENTION

The present invention relates to an internal-combustion engine having a gas inlet port that is subdivided into at least two partial ports by a partitioning wall extending over at least a portion of the length of the port.

In piston-type internal-combustion engines, it is known from, for example, WO 95/17589 and DE-A-198 03 867, to subdivide at least the cylinder port that is connected to the gas-intake valve of each cylinder into two partial ports, over at least part of the port length, using at least one partitioning wall. A control device is provided at the beginning of the partitioning wall, when seen in the flow direction, for at least one of the two partial ports. This device can influence the volume flow that flows through this partial port. Thus, it is possible to purposefully guide the flow through at least one of the partial ports and to a segment of the valve-gap region of the gas-intake valve, and to change the distribution of the air mass or charge mass flowing into the cylinder by throttling the other partial current. Because the distribution of the charge mass via the valve gap dictates the creation of turbulence in the cylinder, the throttling of at least one of the partial ports can control the turbulence formation and intensity in the cylinder. At the same time, it is possible to influence the extent of the mixing of the different charge components. Hence, the mass distribution onto the upper and lower valve-gap regions can be influenced. If a larger proportion of the mass is conducted through the upper valve-gap region, a tumbling effect is created in the cylinder. This tumbling can have a positive effect on combustion and, if desired, permits a stable stratification between the air and fuel and/or the exhaust gas. If the lower partial port is closed, the turbulence also effects a favorable combustion behavior with low engine loads (partial load). With a full load, however, no intensive turbulence is supposed to be generated—in other words, both partial ports should remain open.

For structural reasons, the first partial port, which is preferably the upper one, is connected to the fuel supply such that, for example, a fuel-injection nozzle discharges into this partial port. Depending on the operating mode, if the lower partial port is closed or slightly open, the fuel-air mixture flows through the upper, first partial port and is predominantly guided to the upper valve-gap region. The charge mass supplied to the lower valve-gap region is increased in proportion to the increase of the supply of air or exhaust gas from the exhaust-gas return via the second, lower partial port, so the turbulence formation in the cylinder is reduced corresponding to the increase in the gas flow through the second partial port. If the distribution of the charge mass being conducted through the gas intake onto the two partial ports is controlled, this can infinitely variably influence the intensity of the tumbling. This is also a function of a piston-type internal-combustion engine with direct fuel injection.

A corresponding structural embodiment of the port partition, and/or the selection of the time of the fuel supply (injection time), can have a positive impact on the mixing of the fuel-air mixture or the exhaust gas-fuel-air mixture. The mixture can be intensively mixed (homogeneous mixture) or distinctly stratified. This construction further permits the introduction of exhaust gas into at least one partial port and, depending on the throttling of the other partial port, a more or less defined stratification of the exhaust gas-air-fuel mixture. In an arrangement involving a plurality of intake valves per cylinder, it is possible to provide a common intake region for all of the intake valves, in which the partitioning wall that subdivides the intake port ends, or to allow each intake valve of a cylinder to exert its own influence through a corresponding division into two parallel ports, beginning from a common port part. In the latter case, the partitioning wall effecting a corresponding division extends from the common port area into the region of the two parallel ports, so the end of the partitioning wall can also be brought closely to the valve gap of the relevant intake valve.

It is also known from WO 95/17589 to cast the partitioning wall with corresponding casting cores in the production of the cylinder head, or to place a corresponding structural element comprising a different material, such as a stamped steel sheet, into the casting mold and embed it into the cylinder head.

It is the object of the invention to improve a piston-type internal-combustion engine of the aforementioned type, with respect to the embodiment of its cylinder ports, particularly the gas intake ports.

SUMMARY OF THE INVENTION

In accordance with the invention, the above object generally is achieved with a piston-type internal-combustion engine having at least one cylinder port, which essentially discharges into a cylinder via at least one throughgoing opening, per cylinder. This port is divided, at least over a part of its length, into at least two partial ports by at least one partitioning wall that has a profile with flow channels extending in the flow direction on one surface of the wall. It is preferable for the divisional plane that is defined by the partitioning wall to be oriented essentially transversely to the cylinder axis.

In contrast to the known, smooth-surface embodiment of the partitioning walls, the profile with the flow channels in accordance with the invention offers the option of also profiling the mass flow transversely to its flow direction, that is, to create "strands" with a higher mass-flow density, so the mass flow traversing the relevant partial port is shaped accordingly. With two essentially parallel troughs or flow channels that are disposed at least in the vicinity of the throughgoing opening, for example, it is possible to provide two partial flows that have an increased mass flow, particularly for the upper partial port, and to guide these flows past both sides of the valve stem, which passes through the end region of the intake port, in order to avoid turbulence or an undesired diversion of the mass flow toward the edge. With a corresponding embodiment of the trough or flow channel shape, it is also possible for the main component of the mass flow to be diverted more strongly toward the center of the cylinder, or toward the cylinder wall, depending on the embodiment of the combustion chamber.

While it is possible in principle to provide this type of flow channel shape with respect to the two partial ports, for example, in the form of a wavy cross-section of the partitioning wall, it can be advantageous to allocate the trough shape to only one partial port, for example the upper partial port, while the partitioning wall for the other partial port has a level or flat surface.

A wavy cross-sectional shape of the partitioning wall is advantageous both for a partitioning wall that is cast with the cylinder head and for a partitioning wall that is cast as a separate component, particularly as a separate piece of sheet steel, because the changes in spacing that occur due to thermal expansions caused by different temperature levels can be readily accommodated, and ruptures in the partitioning wall or a loosening of the partitioning wall from the casting material can be avoided. The concept of the invention is not, however, limited to a cast or embedded partitioning wall. A partitioning wall that is inserted later, for example as a steel sheet, into cast slots in the port side wall is technically advantageous, but also solves structural problems that are caused by different thermal expansions.

The invention is described in detail below using schematic drawings of exemplary embodiments.

DETAILED DESCRIPTION OF THE PREFERRED EMBODIMENTS

Figure 1:
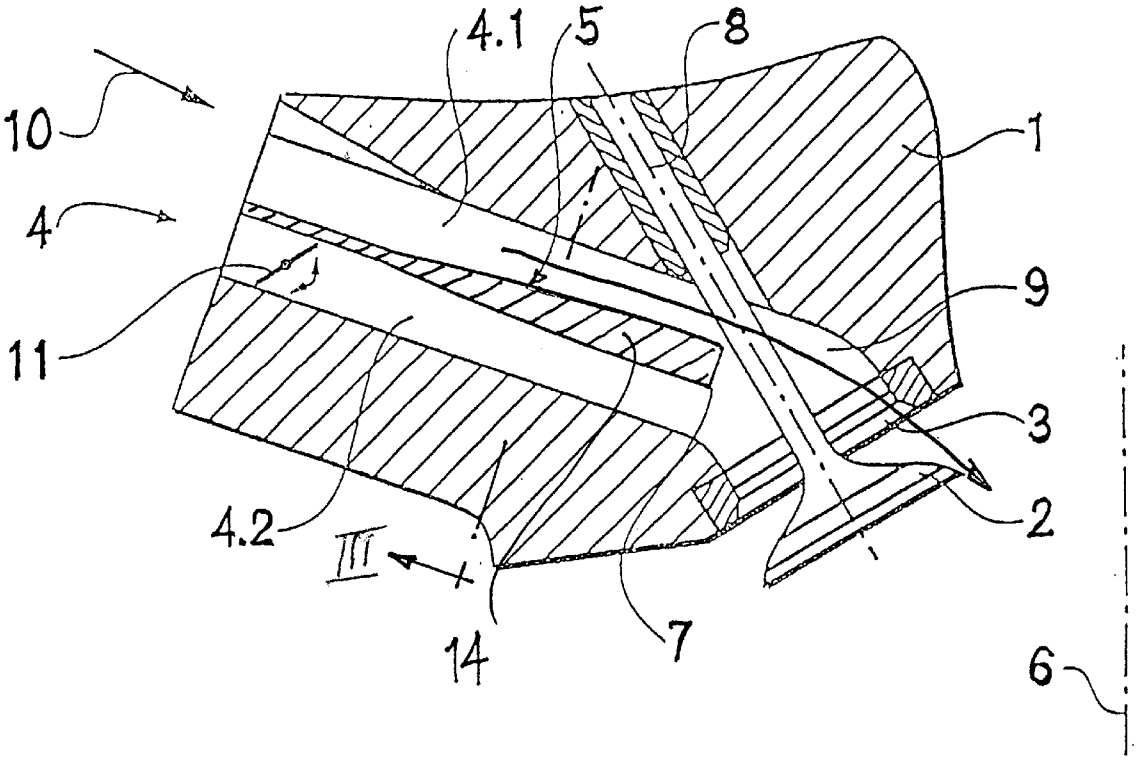
FIG. 1 is a vertical, partial sectional view of the cylinder head region with a gas intake port according to the invention and a gas intake valve and with one partial port closed.
Figure 5:
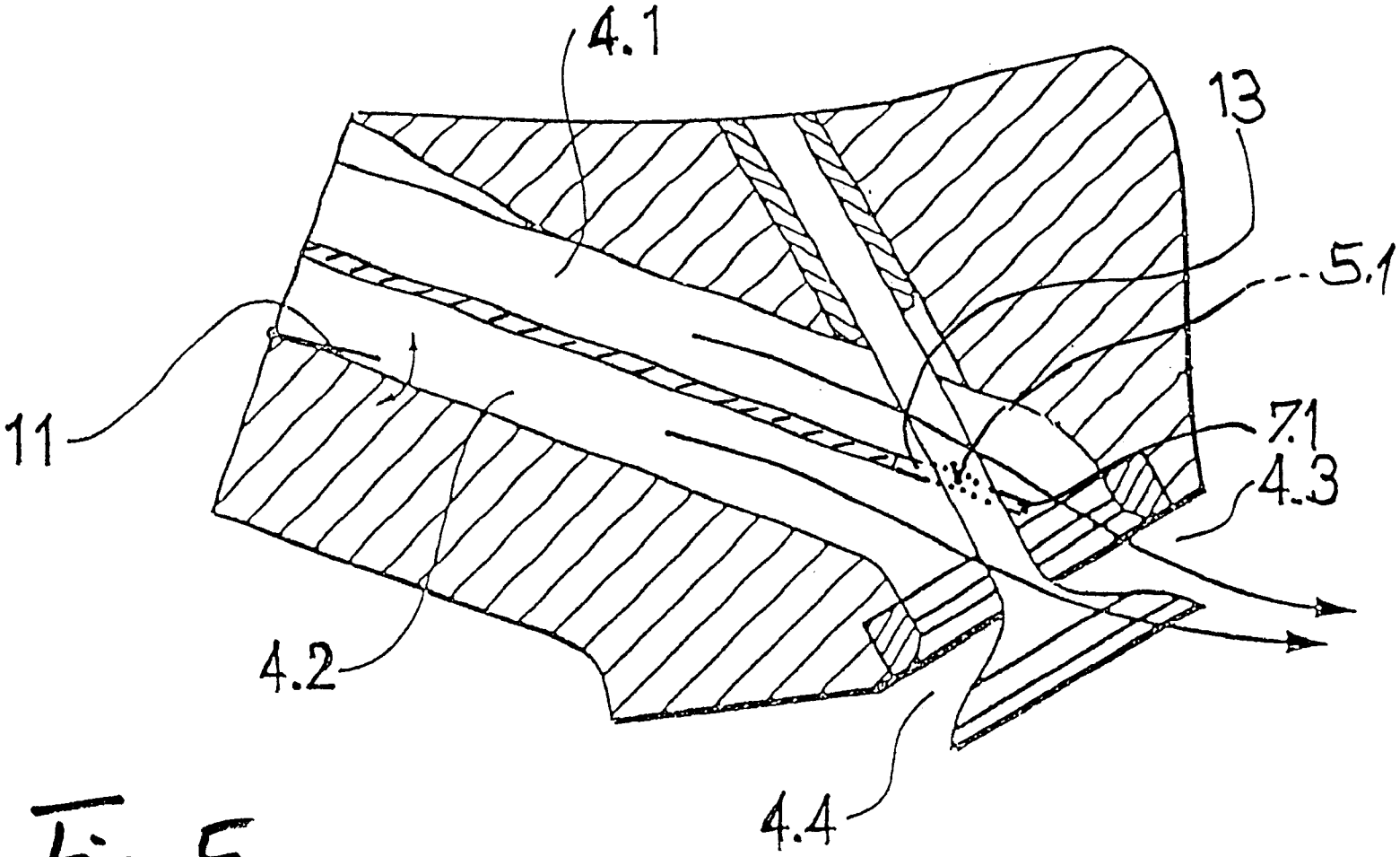
FIG. 5 shows a modification of the embodiment according to FIG. 1.

FIG. 1 is a partial cutout view of a cylinder head 1 of a piston-type internal-combustion engine. In the drawing described below, the engine is provided with an intake valve 2 for each cylinder, with the valve 2 opening and closing an intake opening 3 leading to an engine cylinder. The intake opening 3 is associated with an intake port 4, that is divided by a partitioning wall 5 into a first partial port 4.1 and a second partial port 4.2 in the illustrated embodiment. The partitioning wall 5 extends with its divisional plane transversely to the axis 6 of the cylinder, and its end edge 7 ends directly in front of the stem 8 of the intake valve 2. As can be seen in FIG. 5, the partitioning wall 5 can also be provided in its end region with a recess 13 to form a pair of tongues 5.1 that extend laterally on either side of the stem 8 of the intake valve 2. The end edges 7.1 of the partitioning-wall tongues 5.1 formed by this arrangement can be extended as shown, closely up to the region of the intake opening 3.

The intake port 4, whose partitioning wall 5 forms an angle with the cylinder axis 6, ends in an intake region 9 that is formed by a curved region oriented essentially downward into the cylinder, and is limited by the intake opening 3.

The arrangement is also basically applicable to a plurality of intake valves 2 associated with a cylinder. In this case, either two throughgoing, parallel or mirror-symmetrical intake ports are provided for each intake valve, or a central port part is divided like a fork and guided with two corresponding, parallel ports up to the associated gas intake valves. In this embodiment, the partitioning wall 5 also extends with a corresponding fork-like division into the fork-shaped parallel ports. The term "parallel ports" is not to be understood in strict adherence to the geometrical concept, but encompasses all structures in which corresponding intake ports are associated with a plurality of intake valves.

The injection nozzle, which is not shown in detail here, but is indicated by the arrow 10, discharges into the first partial port 4.1, so a fuel-air mixture is conducted into the cylinder via the partial port 4.1. The partial port 4.2 is charged with air, an exhaust gas-air mixture, an air-fuel mixture, an exhaust gas-air-fuel mixture, or with recirculated exhaust gas, so the mixtures being conducted through the two partial ports 4.1 and 4.2 can be mixed at the earliest at the point where they flow together in the intake region 9.

The lower partial port 4.2 is provided with a device 11 for changing the free flow cross-section, for example, a throttle valve 11, which is actuated as a function of the desired load state of the piston-type internal-combustion engine.

Figure 2:
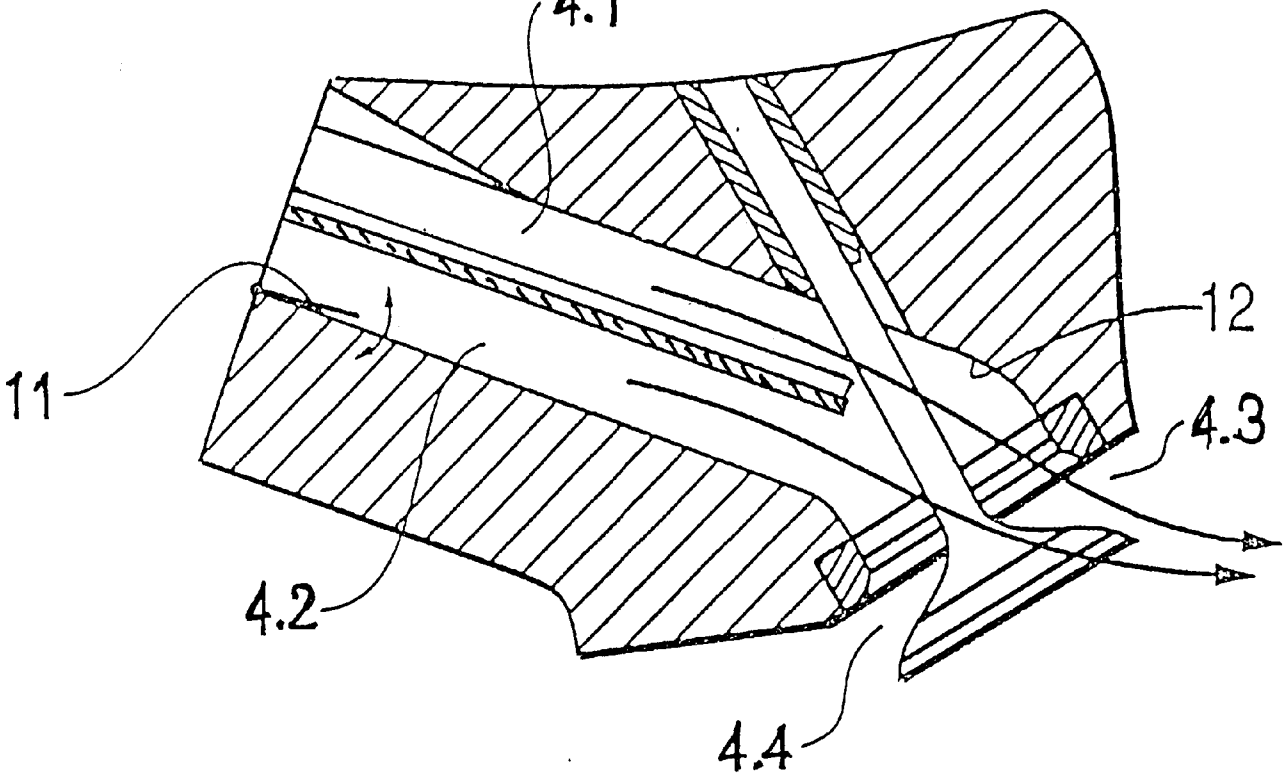
FIG. 2 is the arrangement according to FIG. 1 with both partial ports open to show the different partial flows.

FIGS. 1 and 2 illustrate the different flow directions of the gas flow conducted through the intake port 4 for different opening positions of the throttle valve 11. The different settings of the throttle valve 11 serve to influence the mass distribution onto the upper valve-gap region 4.3 and the lower valve-gap region 4.4 as indicated in FIG. 2. If a larger proportion of the mass passes through the upper valve-gap region 4.3, as is the case, for example, when the throttle valve 11 is partially closed, tumbling occurs in the cylinder of the engine. This tumbling can have a favorable effect on the combustion and, if desired, can effect a stable stratification between the air and the fuel and/or the exhaust gas. When the lower partial port 4.2 is closed, the tumbling also leads to a favorable combustion behavior at low engine loads (partial load). With a full load, no tumbling is supposed to occur; in other words, both partial ports 4.1 and 4.2 should be open.

If, as shown in FIG. 1, the throttle valve 11 reduces the volume flow through the lower partial port 4.2 relative to the volume flow through the upper partial port 4.1, a larger proportion of the total mass is conducted through the upper valve-gap region 4.3 into the cylinder than through the lower valve-gap region 4.4. The distribution of the charge masses onto the two valve-gap regions can thus control the intensity of the tumbling occurring in the cylinder.

If the partitioning wall 5 has a level surface, the stem 8 of the intake valve 2 acts as a "spoiler body" for the incoming mass flow, inducing a corresponding separating turbulence at its rear side, when seen in the flow direction.

Figure 3:
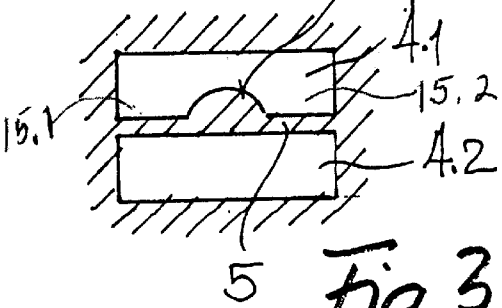
FIG. 3 is a cross-section through a partial port along the line III in FIG. 1 to illustrate one embodiment of the partitioning wall according to the invention.

To improve the flow conditions, the partitioning wall 5 has a profile, at least in the vicinity of the end edge 7, with at least two flow channels on at least one surface of the partitioning wall 5. For example, as shown in FIG. 3, the upper surface of the partition wall 5 can be provided with an upward extending separating or guiding body or portion 1 at the end region of the wall 5 opposite the stem 8, to form flow channels 15.1 and 15.2 on either side of the stem 8. This practically divides the main quantity of the air flow guided through the upper partial port 4.1 into two partial flows, which are guided past the stem 8 on both sides. The arrangement can be such that the separating body portion 14 is only provided on the side of the partitioning wall 5 facing the upper partial port 4.1, while the lower side of the partitioning wall 5 has a smooth surface as shown, because the turbulence created behind the valve stem 8 has a reduced impact with a full load and a completely open partial port 4.2. However, it is to be understood that both surfaces of the partition wall 5 can be provided with a separating body or portion 14, if desired.

Figure 4:
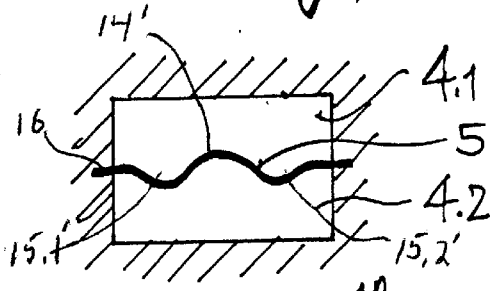
FIG. 4 is a cross-section similar to that of FIG. 3, with a modified embodiment of a partitioning wall.

FIG. 4 shows a modification in which the cross-sectional form of the partitioning wall 5 has a wavy profile with respect to the two partial ports 4.1 and 4.2. For the upper partial port 4.1, this profile leads to a trough or channel structure that, due to the upward central wave or undulation 14' that acts as a separating body or portion, conducts the air flow in the partial port 4.1, which is essentially divided into two air flows, in flow channels 15.1' and 15.2', and past both sides of the valve stem 8.

The embodiments according to FIGS. 3 and 4 can either extend over only a partial length of the partitioning wall 5, as in the longitudinal section according to FIG. 1, or over the entire length of the partitioning wall 5.

As shown in FIG. 3, the partitioning wall 5 with its separating body or portion 14 can be cast or formed as an integral part of the cylinder head. However, particularly when the dual flow channel formed profile extends over the entire length of the partitioning wall 5, the embodiment according to FIG. 4 has the advantage that it can be placed into the casting core as a separate component, such as a separate sheet element, and its end 16 embedded with the part of the cylinder head that forms the gas-intake port 4. Thus, various thermal expansions of the cylinder-head material, such as aluminum, and the partitioning-wall material, such as a heat-resistant steel sheet, can be accommodated without difficulty. The wavy structure shown in a cross-section in FIG. 4 offers the advantage of compensating different thermal expansions due to surface temperature variations, even in the case of an embedded partitioning wall 5.

With a corresponding guidance in the gas-flow direction by the channels formed by the wavy profile of the partitioning wall 5, depending on the requirements, the flow guided through the gas-intake opening 3 can also be influenced transversely relative to the cylinder. Consequently with a corresponding embodiment and orientation of the channels in the region of the end edge 7, especially if, as shown in FIG. 5, a corresponding recess is provided in the partitioning wall 5, the end edge 7.1, in the form of partitioning-wall tongues 5.1, is guided close to the intake region 9. A corresponding shape of the partitioning-wall tongues 5.1 allows a transverse component to be impressed onto the gas flow.

The above-described embodiments of a partitioning wall can also be used in gas exhaust ports if the flow of the exhaust gas is to be improved in the manner of a flow rectification, especially if considerable temperature differences can occur between the partitioning wall and the cooled cylinder-head region surrounding the exhaust port in the region of the gas exhaust ports.

The invention now being fully described, it will be apparent to one of ordinary skill in the art that many changes and modifications can be made thereto without departing from the spirit or scope of the invention as set forth herein.

What is claimed is:

1. A piston-type internal-combustion engine having: at least one gas intake port per cylinder, with the port discharging into the cylinder via at least one throughgoing opening; and at least one partitioning wall disposed within the port and extending along at least a portion of the length of the port and subdividing the port into at least two partial ports, with the wall having a cross sectional profile with a separating portion, that extends in the flow direction within the port, on at least one surface of the wall, and that is raised relative to adjacent remaining portions of the at least one surface to divide a flow in an associated one of said at least two partial ports into at least two partial flows; and wherein the profile of the partitioning wall is wavy between its two ends with the separating portion being formed by an upwardly directed undulation between downwardly directed undulations whereby the downwardly directed undulations form flow channels on said at least one surface.

2. The piston-type internal-combustion engine according to claim 1, wherein the raised separating portion is substantially centrally disposed on the at least one surface so that the partial flows extend on either side of a valve stem associated with the port.

3. The piston-type internal-combustion engine according to claim 1, wherein a divisional plane defined by the partitioning wall is oriented essentially transversely to a longitudinal axis of the cylinder.

4. The partitioning wall according to claim 1, whereby the partitioning wall consists of a preformed piece of sheet steel.

5. The piston-type internal-combustion engine according to claim 1, wherein the partitioning wall is secured at its longitudinal edges to the port wall.

6. The piston-type internal-combustion engine according to claim 1, wherein the longitudinal edges of the partitioning wall are embedded in the material of the port wall.

7. The piston-type internal-combustion engine according to claim 1, wherein the partitioning wall is integral with a wall defining the port.

8. The piston-type internal-combustion engine according to claim 1, wherein the separating portion is disposed opposite a valve stem associated with the at least one port and opening.

* * * * *